US005900891A

United States Patent [19]

Shimoda

[11] Patent Number: 5,900,891

[45] Date of Patent: May 4, 1999

[54] INK JET RECORDING METHOD AND INK JET RECORDING APPARATUS

[75] Inventor: Junji Shimoda, Chigasaki, Japan

[73] Assignee: Canon Kabushiki Kaisha, Tokyo, Japan

[21] Appl. No.: 09/009,737

[22] Filed: Jan. 20, 1998

Related U.S. Application Data

[63] Continuation of application No. 08/280,125, Jul. 25, 1994, abandoned.

[30] Foreign Application Priority Data

Jul. 26, 1993 [JP] Japan ..... 5-184208

[51] Int. Cl.[6] ..... B41J 2/21; B41J 2/205

[52] U.S. Cl. ..... 347/43; 347/15

[58] Field of Search ..... 347/43, 15, 11, 347/13

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,124,722 | 6/1992 | Moriyama et al. | 347/9 |
| 5,220,342 | 6/1993 | Moriyama | 347/43 |
| 5,223,937 | 6/1993 | Moriguchi et al. | 347/3 |
| 5,359,355 | 10/1994 | Nagoshi et al. | 347/9 |
| 5,488,398 | 1/1996 | Matsubara et al. | 347/43 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—N. Le
*Assistant Examiner*—Thinh Nguyen
*Attorney, Agent, or Firm*—Fitzpatrick, Cella, Harper & Scinto

[57] ABSTRACT

To record a monochromatic image and a color image with a suitable amount of ink, the ink jet apparatus sets an ejecting frequency of ink droplets in printing the monochromatic image with one recording head to be double an ejecting frequency in printing the color image with plural recording heads. Alternatively, scanning speed of recording heads in printing the color image with plural recording heads is set to be double the speed in printing the monochromatic image with one recording head. This assures that the maximum number of the ink droplets ejected within one pixel of the recording medium from recording heads in printing the monochromatic image is equal to the maximum number in printing the color image.

22 Claims, 5 Drawing Sheets

INK JET RECORDING METHOD AND INK JET RECORDING APPARATUS

This application is a continuation application of patent application Ser. No. 08/280,125, filed Jul. 25, 1994, now abandoned.

BACKGROUND OF THE INVENTION

1. Field of the Invention

The present invention relates generally to an ink jet recording method and an ink jet recording apparatus. More particularly, the present invention relates to an ink jet recording method and an ink jet recording apparatus in which a multi-colored image can be recorded on a recording medium using plural kinds of inks each having a different color, and moreover, a monochromatic color can be recorded on the recording medium using a monochromatic ink.

2. Description of the Related Art

When a multi-colored image (that is called a color image) is recorded on a recording medium by employing an ink jet recording method, four kinds of inks each having a different color, i.e., yellow ink, magenta ink, cyan ink and black ink have been hitherto used. Thus, each recording operation is achieved using these inks by ejecting ink droplets to the recording medium and then mixing them with each other on the recording medium to exhibit a desired mixed color. When each ejected ink droplet has a small weight, i.e., a small quantity of ink is ejected from a recording head, a density of recorded color image is reduced. On the contrary, when a large quantity of ink is ejected from the recording head, a part of the recorded image having inks mixed with each other to exhibit a mixed color (i.e., mixed color obtained by mixing yellow ink with magenta ink, mixed color obtained by mixing magenta ink with cyan ink, and mixed color obtained by mixing cyan ink with yellow ink) and the boundary between recorded parts each having a different mixed color exhibits a largely stained state (that is called a malfunction of bleeding), resulting in a quality of recorded color image being degraded. In the case that a certain image is formed on a recording medium with a small quantity of ejected ink, a density of recorded image exhibiting a mixed color is excessively reduced. For this reason, it is necessary to preliminarily determine an optimum quantity of ink ejected from the recording head without any occurrence of a malfunction such as color-staining, bleeding or the like before a recording operation is performed with plural kinds of inks each having a different color. For example, when each recording operation is achieved with a recorded image density of 360 dpi, it is preferably acceptable that a quantity of ink ejected from the recording head is set to 40 ng.

However, in the case that a monochromatic image is formed on the recording medium using ink having a single specific color, when a quantity of ejected ink is set to be equal to that at the time when a color image is formed on the recording medium, a density of recorded monochromatic image is reduced. Thus, there arises a problem that an optimum quality of recorded image can not be obtained with ink having the foregoing color.

SUMMARY OF THE INVENTION

The present invention has been made in consideration of the aforementioned background.

An object of the present invention is to provide an ink jet recording method which assures that not only a multi-colored image having plural kinds of inks used therefor but also a monochromatic image having a single kind of ink used therefor can be recorded on a recording medium with an optimum quantity of ejected ink.

Another object of the present invention is to provide an apparatus to be operated for practicing the foregoing type of ink jet recording method.

According to a first aspect of the present invention, there is provided an ink jet recording method for an ink jet recording apparatus having plural recording heads comprising the steps of:

making relative movement between at least one of the recording heads and a recording medium, ejecting ink droplets from the at least one of recording heads to form monochromatic image or color image on the recording medium while scanning the at least one of recording heads, and setting an ejecting frequency of each recording head at the time of printing monochromatic image to be higher than that at the time of printing color image so that a maximum amount of ink droplets that is ejected within one pixel of the recording medium at the time of printing monochromatic image is larger than that of ink droplets at the time of printing color image.

According to a second aspect of the present invention, there is provided an ink jet recording method for an ink jet recording apparatus having plural recording heads comprising the steps of:

making relative movement between at least one of the recording heads and a recording medium, an ejecting step for ejecting ink droplets from the at least one of recording heads to form monochromatic image or color image on the recording medium while scanning the at least one of recording heads, and setting a speed of the at least one of recording heads at the time of printing monochromatic image to be slower than that of the at least one of recording heads at the time of printing color image so that a maximum amount of ink ejected within one pixel of the recording medium at the time of printing monochromatic image is larger than that of ink ejected within one pixel at the time of printing color image.

According to a third aspect of the present invention, there is provided an ink jet recording method for an ink jet recording apparatus which includes plural recording heads each of which ejects different ink having different color comprising the steps of:

making relative movement between at least one of the recording heads and recording medium, setting an amount of ink droplets ejected from each of the recording heads within one pixel of the recording medium at the time of printing monochromatic image to be larger than that of ink droplets at the time of printing color image, and ejecting ink droplets from at least one of the recording heads at the time of printing color image and ejecting ink droplets from one recording head at the time of printing monochromatic image while scanning the one or at least one of the recording heads.

According to a fourth aspect of the present invention, there is provided an ink jet recording apparatus comprising:

a plurality of recording heads each of which ejects ink droplets, a scanning means for making relative movement between at least one of the recording heads and recording medium, image forming means for forming monochromatic image or color image on the recording medium by scanning the at least one of recording heads with the scanning means, and setting means for setting an ejecting frequency of each head at the time of printing monochromatic image to be higher than that of each head at the time of printing color image so that a maximum amount of ink ejected within one pixel of the recording medium at the time of printing monochromatic image is larger than that of ink ejected within one pixel at the time of printing color image.

According to a fifth aspect of the present invention, there is provided an ink jet recording apparatus comprising:

a plurality of recording heads for ejecting ink droplets, a scanning means for making relative movement between at least one of the recording heads and recording medium, image forming means for forming monochromatic image or color image on a recording medium by scanning the at least one of recording heads with the scanning means, and setting means for setting a speed of the at least one of recording heads at the time of printing monochromatic image to be slower than that of the at least one of recording heads at the time of printing color image so that a maximum amount of ink ejected within one pixel of the recording medium at the time of printing monochromatic image is larger than that of ink ejected within one pixel at the time of printing color image.

According to a sixth aspect of the present invention, there is provided an ink jet recording apparatus comprising:

a plurality of recording heads each of which ejects different ink having different color, a scanning means for making relative movement between at least one of the recording heads and recording medium, and setting means for setting an amount of ink ejected from each of the recording heads within one pixel of the recording medium.

The above and other objects, effects, features and advantages of the present invention will become more apparent from the following description of embodiments thereof taken in conjunction with the accompanying drawings.

DESCRIPTION OF THE PREFERRED EMBODIMENTS

The present invention will now be described in detail hereinafter with reference to the accompanying drawings which illustrate a few preferred embodiments thereof.

Figure 1:
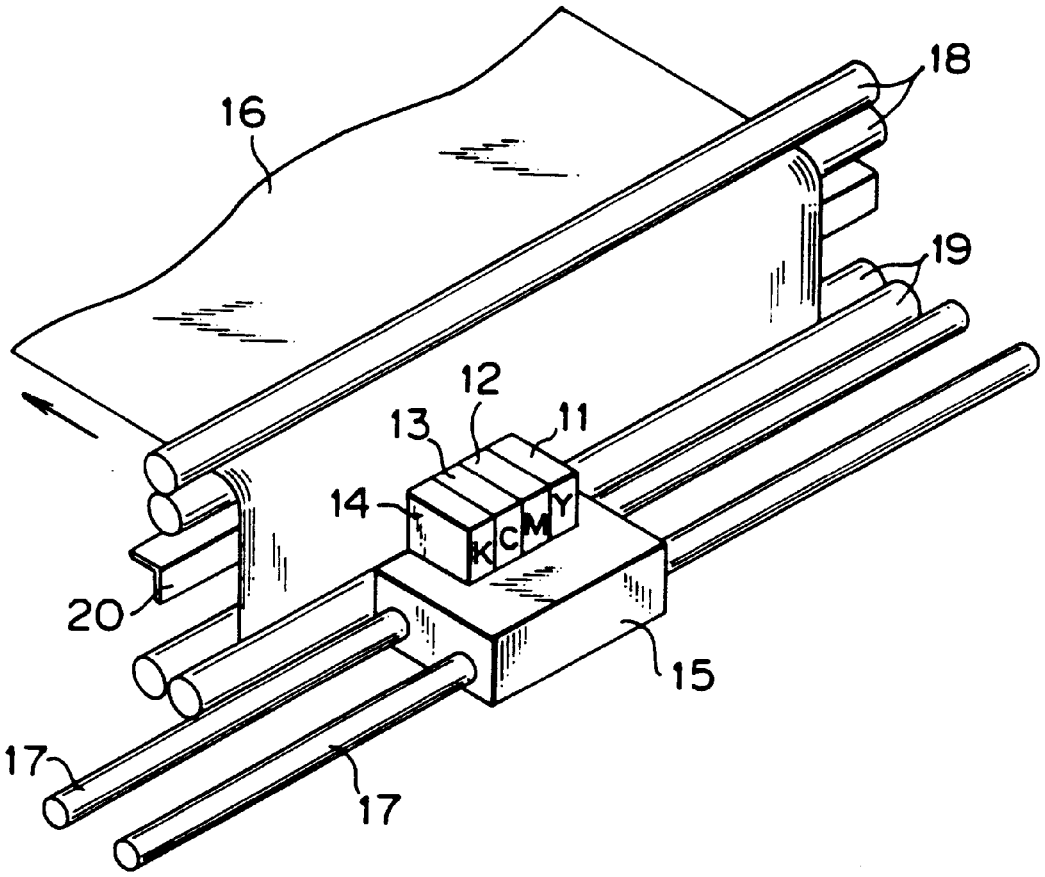
FIG. 1 is a fragmentary perspective view of an ink jet recording apparatus to which the present invention can be applied, schematically showing the arrangement of essential components constituting the ink jet recording apparatus.

FIG. 1 shows by way of fragmentary perspective view the structure of an ink jet recording apparatus to which the present invention can be applied. In the drawing, reference numerals 11, 12, 13 and 14 designate a plurality of recording heads each of which serves to eject ink having a different color therefrom. In the shown case, it is assumed that the recording head 11 ejects ink having a yellow color, the recording head 12 ejects ink having a magenta color, the recording head 13 ejects ink having a cyan color, and the recording head 14 ejects ink having a black color. The recording heads 11 to 14 are constructed separately from each other while having a same structure, respectively, and they are immovably arranged on a carriage 15 in the side-by-side relationship as seen in the horizontal direction in such a manner as to move together with the carriage 15 in the horizontal direction. Reference numeral 16 designates a recording paper (to serve as a recording medium). A series of ink droplets each composed of plural kinds of inks each having a different color in the mixed state are sequentially landed onto the recording paper 16. The recording paper 16 is displaced in the vertical direction at a right angle relative to the scanning direction of the carriage 15.

Each of the recording heads 11 to 14 includes a plurality of ink ejection ports, e.g., sixty four ink ejection ports (not shown) which are formed on the surface of each recording head facing to the recording paper 16 in such a manner as to allow them to be arranged in the equally spaced relationship as seen in the conveying direction of the recording paper 16. An electrothermal converting element for generating thermal energy required to eject ink from each recording head is disposed on a base board for the recording head corresponding to an ink path formed in the recording head. In response to an electrical pulse applied to the electrothermal converting element based on driving data, the electrothermal converting element is activated to generate heat. Thus, a phenomenon of film boiling appears in ink, causing gas bubbles to be formed in the ink, and as the gas bubbles grow, the ink is ejected from the ejection ports. A common liquid chamber is formed in the ink path in each recording head in such a manner that it is communicated with common liquid chambers in other recording heads. The ink stored in each common liquid chamber is fed to the ink path as ink is ejected from the ejection ports.

The recording heads 11 to 14 are mounted on the carriage 15. Slidable movement of the carriage 15 is guided by a pair of guide rails 17 extending in parallel with the recording surface of the recording paper 16. With this construction, the recording heads 11 to 14 are slidably displaced along the guide rails 17. As the recording heads 11 to 14 are slidably displaced in that way, ink is ejected from the ejection ports toward the recording surface of the recording paper 16 in the predetermined timing relationship, whereby a recording operation is achieved with the recording heads 11 to 14. After completion of the slidable displacement of the recording heads 11 to 14, the recording paper 16 is conveyed by a predetermined quantity in the arrow-marked direction in FIG. 1, and thereafter, the recording heads 11 to 14 are slidably displaced again to perform a next recording operation. Thus, a series of recording operations are sequentially performed for the recording paper 16 with the recording heads 11 to 14 by repeating the slidable displacement of the carriage 15 as mentioned above. The conveyance of the recording paper 16 is achieved by rotating a pair of conveying rollers 18 and 19 disposed above and below the recording surface of the recording paper 16. To hold the recording surface of the recording medium 16 in the correctly flattened state at all times, a platen 20 is disposed on the rear surface side of the recording paper 16.

The slidable displacement of the carriage 15 is achieved by driving, e.g., a belt (not shown) fastened to the carriage 15 with the aid of a motor (not shown). In addition, the conveying rollers 18 and 19 are rotated by transmitting the rotational force generated by a paper feeding motor (not shown) to the conveying rollers 18 and 19.

Figure 2:
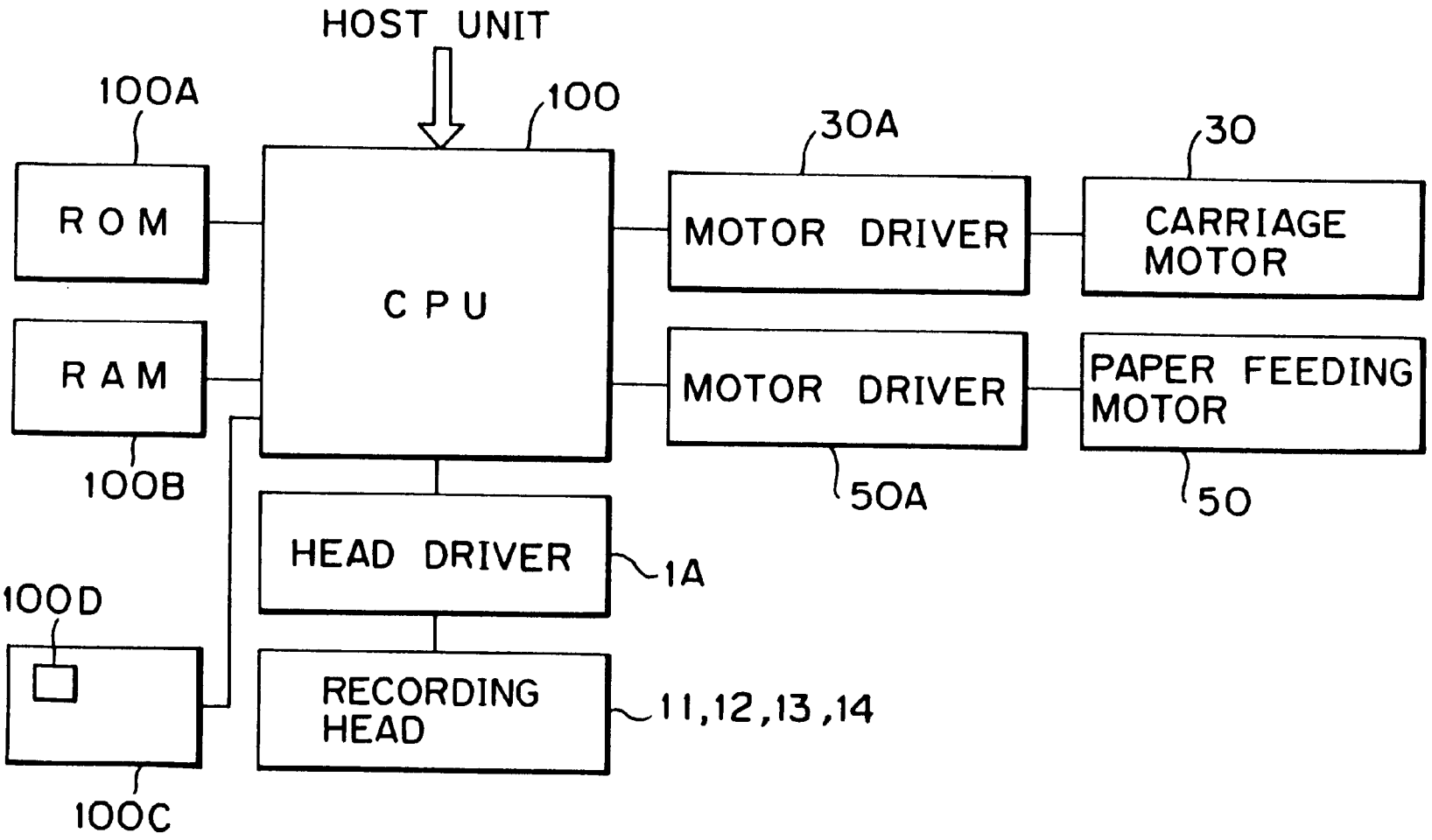
FIG. 2 is a block diagram which shows the structure of a controlling system for the ink jet recording apparatus shown in FIG. 1.

Referring to FIG. 2, the controlling system includes a central processing unit (hereinafter referred to simply as CPU) 100 which serves to control operations to be performed by components in the ink jet recording apparatus, and moreover, execute data processing for the ink jet recording apparatus. In addition, the controlling system includes a read only memory 100A in which a procedure of processings to be executed by CPU 100 is stored, and moreover, it includes a random access memory 100 B which is used as a work area for executing the foregoing processings.

As CPU 100 applies driving data and a driving control signal for the electrothermal converting element to a head driver 1A, ink droplets are ejected from the recording heads 11 to 14. The head driver 1A serves to control the frequency of ejection of ink droplets from the recording heads 11 to 14. In addition, CPU 100 activates a carriage motor 30 for slidably displacing the carriage 15 and a paper feeding motor 50 for rotationally driving the conveying rollers 18 and 19, with the aid of a motor driver 30A and a motor driver 50A. Additionally, CPU 100 controls a scanning speed of each recording head by controlling the rotational speed of the carriage motor 30.

Figures 3A, 3B, 3C:
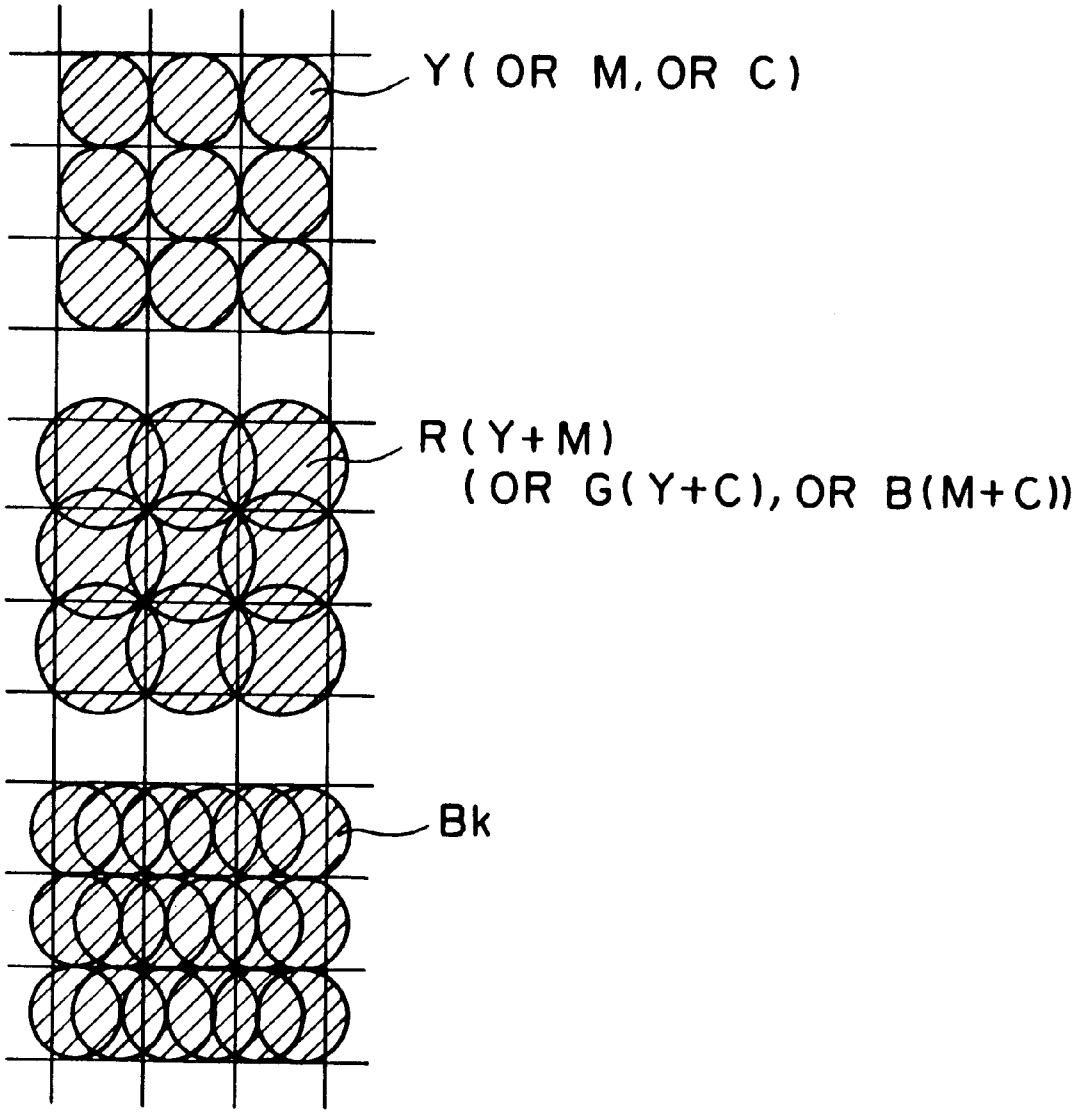
FIG. 3A to FIG. 3C are illustrative views which show the state that an image is recorded on a recording medium by employing an ink jet recording method to be practiced in accordance with an embodiment of the present invention, respectively.

FIG. 3A to FIG. 3C show by way of illustrative views an ink jet recording method to be practiced in accordance with an embodiment of the present invention wherein either of a multi-colored image (that is called a color image) and a monochromatic image is formed on a recording paper by operating the ink jet recording apparatus constructed in the above-described manner, respectively.

In detail, FIG. 3A shows the case that one pixel is formed with one dot recorded by one of Y (yellow ink), C (cyan ink) and M (magenta ink). Next, FIG. 3B shows the case that an image is recorded with plural kinds of colors, i.e., R (red) obtained by mixing Y (yellow ink) and M (magenta ink) with each other, G (green) obtained by mixing Y (yellow ink) and C (cyan ink) with each other, and B (blue) obtained by mixing M (magenta ink) and C (cyan ink) with each other. In the shown case, ink droplets having two different kinds of colors are sequentially landed onto a same position located within the range defined by one pixel, and subsequently, the two colors of the ink droplets are mixed with each other on the recording paper, whereby an image composed of R (red), G (green) and B (blue) in the color-mixed state is recorded on the recording paper 16.

Referring to FIG. 3A and FIG. 3B again, a quantity of ink corresponding to one dot recorded on the recording paper with ink droplets is determined such that a quantity of ink required when one pixel is formed with two dots represents an allowable upper limit value, i.e., a limit value corresponding to a quantity of ejected ink which assures that a high quality of image can be maintained without any occurrence of malfunctions that a recorded image is stained, the recorded image is incorrectly fixed, and the color-mixed ink of the recorded image reaches the rear surface of the recording paper. For example, in the case that a recorded pixel has a density of 360 dpi, the limit value representing a total quantity of ink droplets landed onto the recording paper within the range defined by one pixel is 80 ng. For this reason, a quantity of ink droplets landed onto the recording paper corresponding to one dot is a half of the foregoing limit value, i.e., about 40 ng.

FIG. 3C shows by way of illustrative view the case that a monochromatic image is recorded on the recording paper using only BK (black ink). In this case, an image is recorded on the recording paper by forming two dots of BK (black ink) within the range defined by one pixel. In other words, ink droplets are continuously ejected from the recording head 14 shown in FIG. 1 to record two dots per one pixel on the recording paper. In this embodiment, the period of ejection of ink droplets from the recording head 14 is coincident with the period of ejection of ink droplets at the time when a color image is recorded on the recording paper. Accordingly, a moving speed of the carriage 15 at the time when a monochromatic image is recorded on the recording paper is reduced to a level corresponding to a half of the moving speed of the carriage 15 at the time when a color image is recorded on the recording paper, resulting in a recording speed of the recording head 14 being likewise reduced to about a half. In contrast with the case shown in FIG. 3B, in the case shown in FIG. 3C, since ink droplets corresponding to two dots within the range defined by one pixel are ejected from the recording head 14, the positions where the ink droplets are landed onto a recording paper are offset in the moving direction of the carriage 15. In other words, in the case shown in FIG. 3C, since ink droplets of BK (black ink) corresponding to two dots are ejected from the recording head 14 within the range defined by one pixel, a density of each recorded image is increased, resulting in a high quality of monochromatic image being obtained. Thus, in the case of 360 dpi, a quantity of ink ejected in the form of ink droplets per one pixel is estimated to assume a value approximately represented by an equation of $40\times2=80$ ng.

Figures 4A, 4B, 4C:
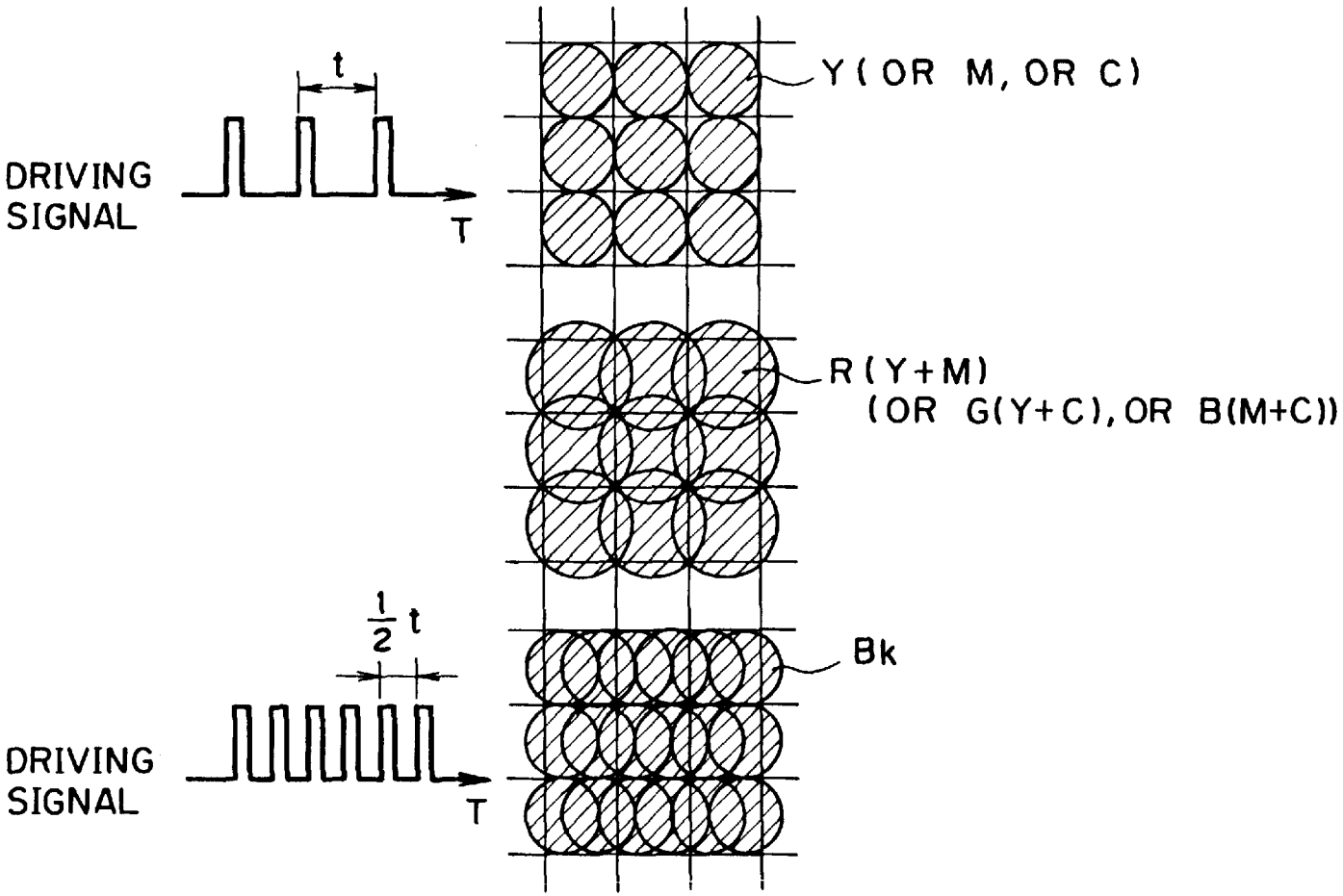
FIG. 4A to FIG. 4C are illustrative views which show the state that an image is recorded on a recording medium by employing an ink jet recording method to be practiced in accordance with another embodiment of the present invention, respectively.

FIG. 4A to FIG. 4C show by way of illustrative views an ink jet recording method to be practiced in accordance with another embodiment of the present invention.

In detail, similar to FIG. 3A, FIG. 4A shows the case that one pixel is formed with one dot recorded with ink selected from Y, C and M. In addition, similar to FIG. 3B, FIG. 4B shows the case that one pixel is formed in the color-mixed state with two dots selected from Y, M and C and an image is formed from the pixels of R, G and B. Additionally, similar to FIG. 3C, FIG. 4C shows the case that one pixel is formed with two dots recorded with black ink to record a monochromatic image. In this embodiment, the period of each driving signal applied to the recording head 14 in the case shown in FIG. 4C, i.e., the ejection period of each ink droplet ejected from the recording head 14, is set to a half of the ejection period (t) in the case shown in FIG. 4A and FIG. 4B. Therefore, the recording speed applicable to a color image is equalized to the recording speed applicable to a monochromatic image, whereby each image can be recorded on the recording paper at a constant speed.

Figures 5A, 5B:
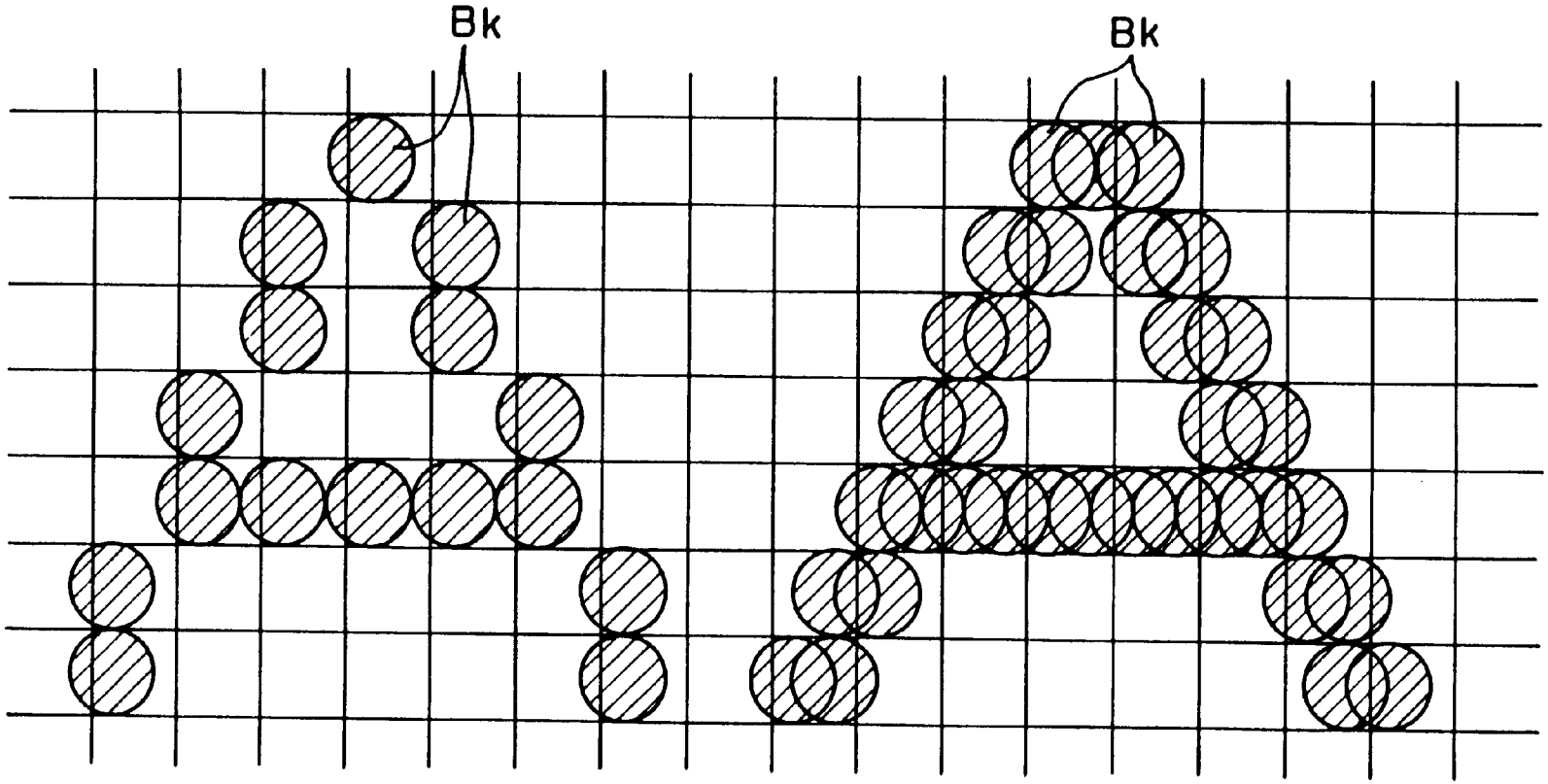
FIG. 5A and FIG. 5B are illustrative views which show the state that an image is recorded on a recording medium by employing an ink jet recording method to be practiced in accordance with a further embodiment of the present invention, respectively.

FIG. 5A and FIG. 5B show by way of illustrative views an ink jet recording method to be practiced in accordance with another embodiment of the present invention, respectively.

In this embodiment, a recording operation can be achieved for recording a color image on the recording paper in the same manner as that in the case shown in FIG. 3A, FIG. 3B, FIG. 4A and FIG. 4B. However, in contrast with the case shown in FIG. 3C and FIG. 4C, either of a recording operation to be achieved for recording a monochromatic image on the basis of one pixel formed with one dot as shown in FIG. 5A and a recording operation to be achieved for recording a monochromatic image on the basis of one pixel formed with two dots as shown in FIG. 5B can adequately be selected at an operator's discretion. This operator's discretion can be inputted by the operation of switch 100 D, of the operation panel 100*c*; shown in FIG. 2.

In each of the aforementioned embodiments, when a color image is recorded, each of the recording heads 11, 12 and 13 for ejecting yellow ink, magenta ink and cyan ink ejects one ink droplet therefrom for recording one pixel on the recording paper 16, and when a monochromatic image is recorded, the recording head 14 continuously ejects ink droplets therefrom for recording one pixel on the recording paper 16, wherein the maximum number of said ink droplet for one pixel is two. Consequently, on the assumption that an inequality of $1 \leqq f_2/f_1 < 2$ is established, both a color image and a monochromatic image can be recorded on the recording paper 16 at an optimum density while maintaining a high quality, wherein $f_1$ is a maximum ink droplet ejection frequency of each of the recording heads 11, 12 and 13 at the time when a color image is recorded on the recording paper 16 and $f_2$ is a maximum ink droplet ejection frequency of the recording head 14 at the time when a monochromatic image is recorded on the recording paper 16.

The number of the ink droplets ejected within one pixel at the time of printing color image or monochromatic image is not limited to the numbers in the above-described embodiments. For example, 3 ink droplets may be ejected to one pixel in printing monochromatic image.

According to the invention, since the maximum number of the ink droplets ejected within one pixel from each head at the time of printing monochromatic image is larger than that at the time of printing color image, high printing density at the time of printing monochromatic image and high quality of the image are ensured.

According to the invention, a frequency of the ejection of ink droplets at the time of printing monochromatic image can be an integer multiple (for example, double) of a frequency at the time of printing color image to keep the printing speed of the monochromatic image equal to the printing speed of the color image.

While the present invention has been described above with respect to a few preferred embodiments thereof, it should of course be understood that the present invention should not be limited only to these embodiments but various changes or modifications may be made without any departure from the scope of the present invention as defined by the appended claims.

The present invention achieves distinct effects when applied to a recording apparatus which has means for generating thermal energy such as electrothermal transducers or laser light source, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application laid open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to an ink jet recording apparatus having a so-called full-line type recording head whose length equals the maximum length across a recording medium. Such a recording head may consists of a plurality of recording heads combined together, or one integrally arranged recording head.

In addition, the present invention can be applied to various ink jet recording apparatusses having various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system, are a capping means and a cleaning means for the recording head, and a pressure or suction means for the recording head. Examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. In other words, the present invention can be effectively applied to an apparatus having at least two of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording method for an ink jet recording apparatus having a plurality of recording heads electing different colored inks, respectively, said method comprising the steps of:

performing relative movement between at least one of said recording heads and a recording medium; and ejecting ink droplets from said at least one of said recording heads to form a monochromatic image or a multi-color image on said recording medium during the relative movement, wherein a predetermined recording head of said plurality of recording heads is used when printing the monochromatic image without using any other recording head of said plurality of recording heads, and wherein an ejecting frequency of the predetermined recording head when printing the monochromatic image is higher than that of any other recording head of said plurality of recording heads when printing the multi-color image, and a speed of the relative movement when printing the monochromatic image is equal to that when printing the multi-color image, so that an amount of ink droplets that are ejected from the predetermined recording head per pixel of said recording medium when printing the monochromatic image is larger than that of respective colored inks ejected per pixel of said recording medium from said plurality of recording heads when printing the multi-color image.

2. An ink jet recording method for an ink jet recording apparatus having a plurality of recording heads, said method comprising the steps of:

performing relative movement between at least one of said recording heads and a recording medium; and ejecting ink droplets from said at least one of said recording heads to form a monochromatic image or a multi-color image on said recording medium during the relative movement, wherein a predetermined recording head of said plurality of recording heads is used when printing the monochromatic image without using any other recording head of said plurality of recording heads and wherein a speed of the relative movement when printing the monochromatic image is slower than that when printing the multi-color image, and an ejecting frequency of the predetermined recording head when printing the monochromatic image is equal to that of any other recording head of said plurality of recording heads when printing the multi-color image so that an amount of ink ejected from the predetermined recording head per pixel of said recording medium when printing the monochromatic image is larger than that of respective colored inks ejected per pixel from said plurality of recording heads when printing the multi-color image.

3. An ink jet recording method for an ink jet recording apparatus which includes a plurality of recording heads ejecting different colored inks, respectively, said method comprising the steps of:

performing relative movement between at least one of said recording heads and a recording medium; and ejecting ink droplets from at least one of said recording heads when printing a multi-color image and ejecting ink droplets from one recording head when printing a monochromatic image during the relative movement, wherein a predetermined recording head of said plurality of recording heads is used when printing the monochromatic image without using any other recording head of said plurality of recording heads, wherein a plurality of ink droplets are continuously ejected from the predetermined recording head for the same one pixel of said recording medium when printing the monochromatic image, and wherein an amount of ink droplets ejected from the predetermined recording head per pixel of said recording medium when printing the monochromatic image is larger than that of the respective colored inks ejected per pixel of said recording medium from said plurality of recording heads when printing the multi-color image.

4. An ink jet recording method as claimed in claim 3, wherein a maximum amount of ink ejected from each of said recording heads within one pixel of said recording medium when printing the monochromatic image is an integer multiple of an amount of ink ejected within one pixel when printing the multi-color image.

5. An ink jet recording method as claimed in claim 3, wherein a frequency of the ejection of ink from each of said recording heads when printing the monochromatic image is higher than that of the ejection of ink when printing the multi-color image.

6. An ink jet recording method as claimed in claim 4, wherein a frequency of the ejection of ink from each of said recording heads when printing the monochromatic image is an integer multiple of a frequency when printing the multi-color image.

7. An ink jet recording method as claimed in claim 3, wherein a speed of said at least one of said recording heads when printing the multi-color image is higher than that of said at least one of said recording heads when printing the monochromatic image.

8. An ink jet recording method as claimed in claim 4, wherein a speed of said at least one of said recording heads when printing the multi-color image is an integer multiple of a speed when printing the monochromatic image.

9. An ink jet recording method as claimed in claim 4, wherein said recording heads comprise electro-thermal converting elements which generate heat energy, and said ejecting step comprises a step of generating said heat energy to cause film boiling of said ink as an energy to eject said ink droplets.

10. An ink jet recording method as claimed in claim 6, wherein said recording heads comprise electro-thermal converting elements which generate heat energy, and said ejecting step comprises a step of generating said heat energy to cause film boiling of said ink as an energy to eject said ink droplets.

11. An ink jet recording method as claimed in claim 8, wherein said recording heads comprise electro-thermal converting elements which generate heat energy, and said ejecting step comprises a step of generating said heat energy to cause film boiling of said ink as an energy to eject said ink droplets.

12. An ink jet recording apparatus comprising:

a plurality of recording heads each of which ejects ink droplets;

scanning means for performing relative movement between at least one of said recording heads and a recording medium;

image forming means for forming a monochromatic image or a multi-color image on said recording medium by using said plurality of recording heads during the relative movement performed by said scanning means, wherein a predetermined recording head of said plurality of recording heads is used when printing the monochromatic image without using any other recording head of said plurality of recording heads; and setting means for setting an ejecting frequency of the predetermined recording head when printing the monochromatic image to be higher than that of said plurality of recording heads when printing the multi-color image so that an amount of ink ejected from the predetermined recording head per pixel of said recording medium when printing the monochromatic image is larger than that of respective colored inks ejected per pixel from said plurality of recording heads when printing the multi-color image, wherein a speed of the relative movement when printing the monochromatic image is equal to that when printing the multi-color image.

13. An ink jet recording apparatus comprising:

a plurality of recording heads for ejecting ink droplets;

scanning means for performing relative movement between at least one of said recording heads and a recording medium;

image forming means for forming a monochromatic image or a multi-color image on said recording medium by using at least one of said plurality of recording heads during the relative movement performed by said scanning means, wherein a predetermined recording head of said plurality of recording heads is used when printing the monochromatic image without using any other recording head of said plurality of recording heads; and setting means for setting a speed of the relative movement when printing the monochromatic image to be slower than that when printing the multi-color image so that an amount of ink ejected per pixel of said recording medium from the predetermined recording head of said plurality of recording heads when printing the monochromatic image is larger than that of respective colored inks ejected per pixel from said plurality of recording heads when printing the multi-color image, wherein an ejecting frequency of the predetermined recording head when printing the monochromatic image is equal to that of any other recording head of said plurality of recording heads when printing the multi-color image.

14. An ink jet recording apparatus comprising:

a plurality of recording heads which eject different colored inks, respectively;

scanning means for performing relative movement between at least one of said recording heads and a recording medium;

image forming means for forming a monochromatic image or a multi-color image on said recording medium, by using at least one of said plurality of recording heads during the relative movement by said scanning means, wherein a predetermined recording head of said plurality of recording heads is used when printing the monochromatic image without using any other recording head of said plurality of recording heads; and setting means for setting an amount of ink droplets ejected from said predetermined recording head per pixel of the recording medium when printing the monochromatic image to be larger than that of ink droplets elected when printing the multi-color image, wherein a plurality of ink droplets from said predetermined recording head are continuously ejected to the same one pixel of said recording medium when printing the monochromatic image.

15. An ink jet recording apparatus as claimed in claim 14, wherein said setting means sets a maximum amount of ink that is ejected from each of said recording heads within one pixel of the recording medium when printing the monochromatic image to be an integer multiple of an amount of ink ejected within one pixel when printing the multi-color image.

16. An ink jet recording apparatus as claimed in claim 14, wherein said setting means sets a frequency of the ejection of ink droplets from each of said heads when printing the monochromatic image to be higher than that of the ejection of ink droplets when printing the color image.

17. An ink jet recording apparatus as claimed in claim 16, wherein said setting means sets the frequency of the ejection of ink droplets from each of said heads when printing the monochromatic image to be an integer multiple of the frequency when printing the multi-color image.

18. An ink jet recording apparatus as claimed in claim 14, wherein said setting means sets a speed of said at least one of said recording heads when printing the multi-color image to be higher than that of said at least one of said recording heads when printing the monochromatic image.

19. An ink jet recording apparatus as claimed in claim 15, wherein said setting means sets a speed of said at least one of said recording heads when printing the multi-color image to be an integer multiple of a speed when printing the monochromatic image.

20. An ink jet recording apparatus as claimed in claim 15, wherein said recording heads comprise electro-thermal converting elements that generate heat energy to cause film boiling of ink as an energy to eject ink droplets.

21. An ink jet recording apparatus as claimed in claim 17, wherein said recording heads comprise electro-thermal converting elements that generate heat energy to cause film boiling of ink as an energy to eject ink droplets.

22. An ink jet recording apparatus as claimed in claim 19, wherein said recording heads comprise electro-thermal converting elements that generate heat energy to cause film boiling of ink as an energy to eject ink droplets.

* * * * *

UNITED STATES PATENT AND TRADEMARK OFFICE

CERTIFICATE OF CORRECTION

PATENT NO. : 5,900,891

DATED : May 4, 1999

INVENTOR(S) : JUNJI SHIMODA

It is certified that error appears in the above-identified patent and that said Letters Patent is hereby corrected as shown below:

COLUMN 7,
Line 13, "100D," should read --100D--; and "100c;" should read --100C--; and
Line 23, "$1 \leq f_2/f_1 < 2$" should read --$1 \leq f_2/f_1 \leq 2$--.

COLUMN 8,
Line 30, "laid open" should read --Laid-Open--.

COLUMN 9,
Line 52, "electing" should read --ejecting--.

COLUMN 12,
Line 42, "elected" should read --ejected--.

Signed and Sealed this

Thirtieth Day of November, 1999

*Attest:*

*Attesting Officer*

Q. TODD DICKINSON

*Acting Commissioner of Patents and Trademarks*